US005170739A

United States Patent [19]

Kobayashi

[11] Patent Number: 5,170,739

[45] Date of Patent: Dec. 15, 1992

[54] PERSONAL WATER PROPULSION SYSTEM

[75] Inventor: Noboru Kobayashi, Iwata, Japan

[73] Assignee: Yamaha Hatsudoki Kabushiki Kaisha, Iwata, Japan

[21] Appl. No.: 723,834

[22] Filed: Jul. 1, 1991

[30] Foreign Application Priority Data

Jun. 4, 1990 [JP] Japan ..... 2-147094

[51] Int. Cl.[5] ..... B63C 11/46

[52] U.S. Cl. ..... 114/315; 440/6

[58] Field of Search ..... 114/315; 440/6, 7

[56] References Cited

U.S. PATENT DOCUMENTS 3,442,240 5/1969 Wild et al. ..... 114/315

4,843,998 7/1989 Parker ..... 114/315

FOREIGN PATENT DOCUMENTS 2309653 8/1974 Fed. Rep. of Germany ..... 114/315

*Primary Examiner*—Jesûs D. Sotelo

*Attorney, Agent, or Firm*—Ernest A. Beutler

[57] ABSTRACT

A small personal water propulsion system adapted to be worn on the body of a user for propelling a user through a body of water. The propulsion system includes a back mounted battery pack and an electrically powered propulsion motor that is pivotally carried by the battery pack for movement between a front propulsion position and a raised storage position.

7 Claims, 4 Drawing Sheets 11
13
14
15
16
17
18
19
21
22
23
24
25
26
27
28
45
46

PERSONAL WATER PROPULSION SYSTEM

BACKGROUND OF THE INVENTION

This invention relates to a personal water propulsion system and more particularly to an improved, simplified propulsion device that may be worn by a user for propulsion through a body of water.

A wide variety of water propulsion devices have been proposed. For the most part, these propulsion devices are watercraft in which an operator and, if large enough, passengers may be transported through a body of water. There are also provided propulsion devices which permit individual users to have a form of underwater propulsion. These types of devices have comprised sled like devices which the operator grasps with his hands and which are utilized to propel him through the water. Of course, all of these types of devices are quite bulky.

It is, therefore, a principal object of this invention to provide a relatively simple, small personal water propulsion device that may be carried by the body of a user for propelling the user through the water.

It is a further object of this invention to provide an improved and simplified propulsion device that a user may wear on his body and wherein the propulsion unit may be conveniently pivoted or moved to an out of the way position when the operator is travelling on land.

SUMMARY OF THE INVENTION

This invention is adapted to be embodied in a personal water propulsion system that is comprised of a battery pack for containing an electrical power source. An electrically powered water propulsion device for generating a propulsion force through a body of water is movably carried by the battery pack. Means are provided for affixing the battery pack to the body of a user for propulsion through a body of water.

DETAILED DESCRIPTION OF THE PREFERRED EMBODIMENT OF THE INVENTION

Figure 1:
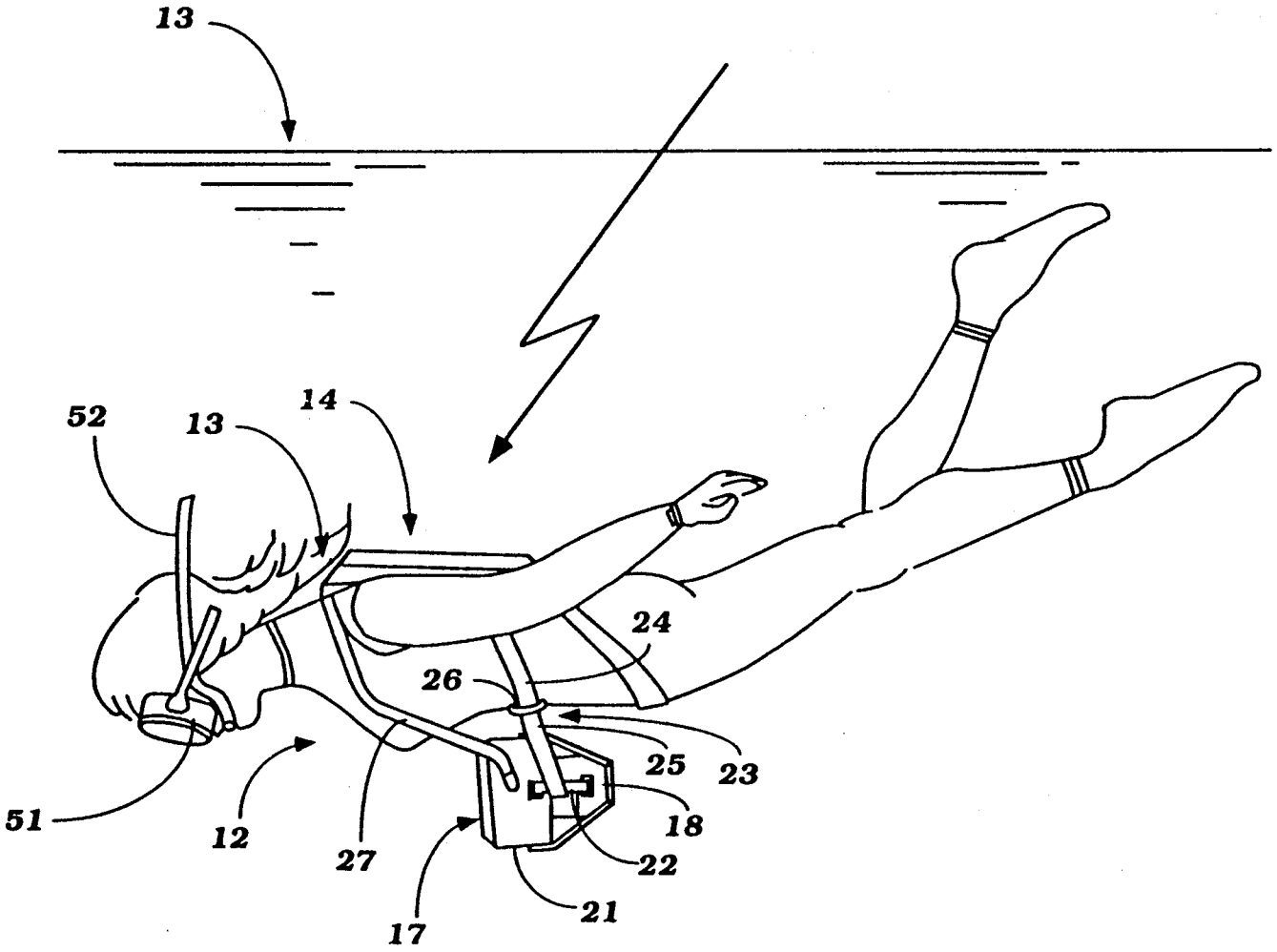
FIG. 1 is a side elevational view showing a water propulsion device constructed in accordance with an embodiment of the invention carried by the user in its operative position and propelling the user beneath a body of water.
Figures 2, 3, 4:
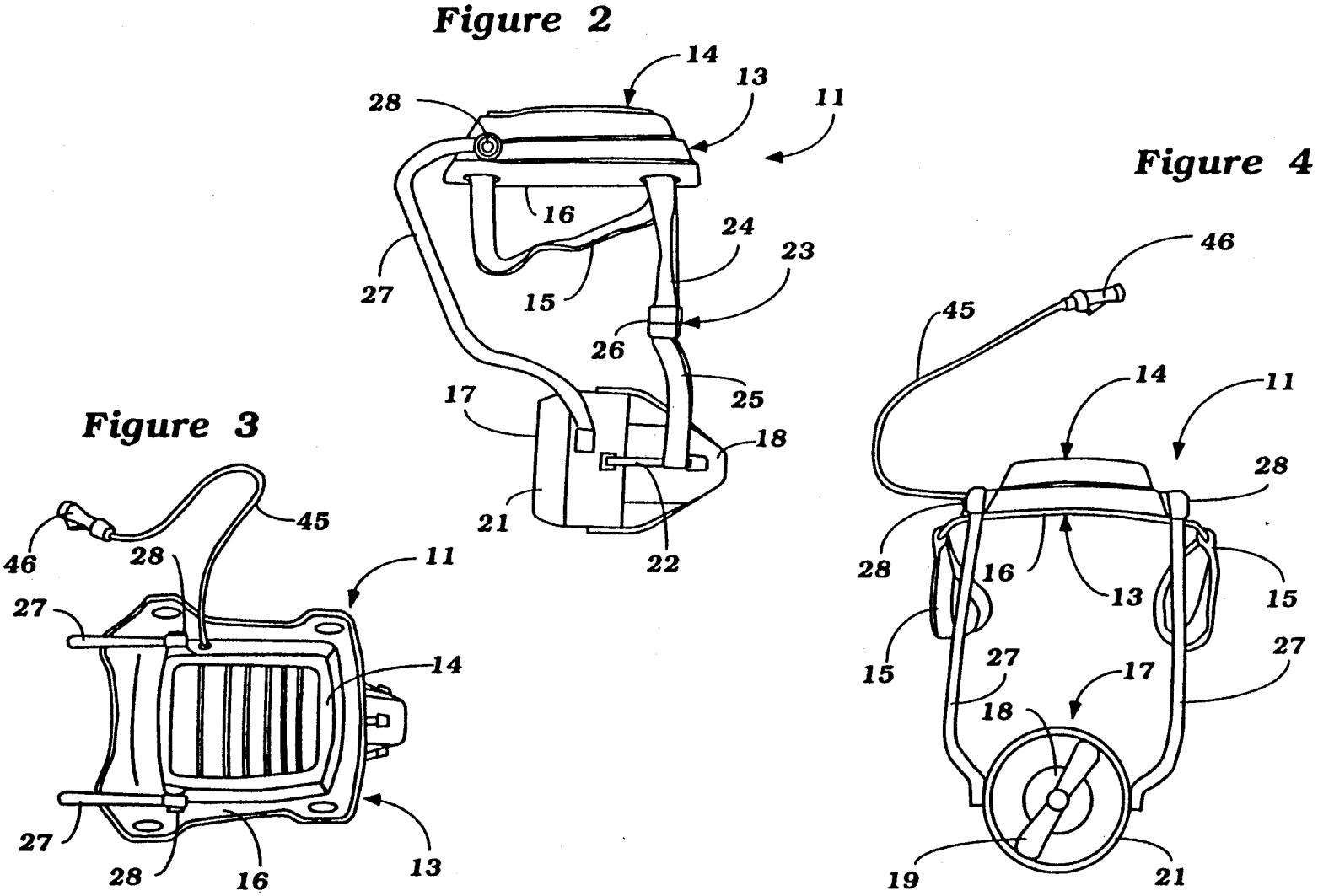
FIG. 2 is an enlarged side elevational view of the propulsion device.
FIG. 3 is a top plan view of the propulsion device.
FIG. 4 is a front elevational view of the propulsion device.
Figure 6:
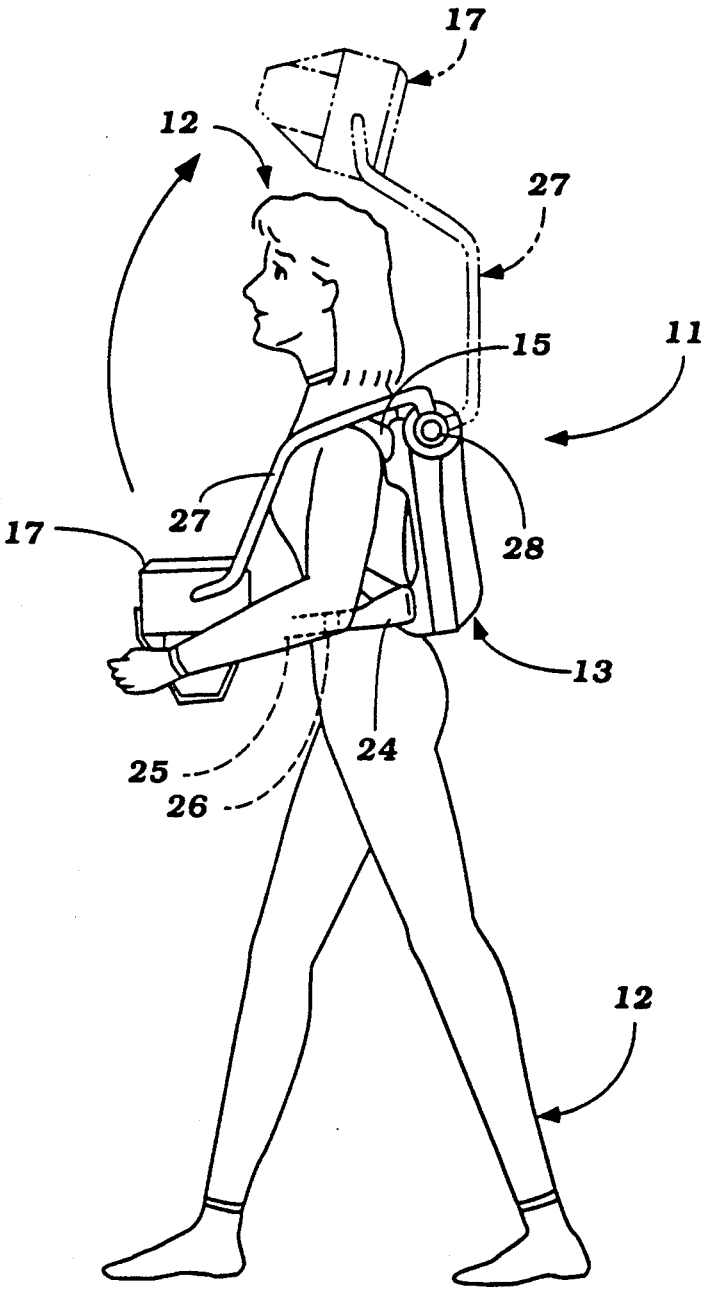
FIG. 6 is a side elevational view showing a user carrying the propulsion device in its propulsion mode in solid line views and in an out of the way position in phantom line views with the user moving along the land.

In the drawings, a personal propulsion device constructed in accordance with an embodiment of the invention is identified generally by the reference numeral 11 and is shown in FIG. 1 as attached to the body of a user, indicated by the reference numeral 12, when submerged in a body of water 13. The propulsion unit 11 is also adapted to be worn by the user when travelling on land as shown in FIG. 6.

The propulsion unit 11 is comprised of two main elements, a battery pack 13 and a propulsion device to be described. The battery pack 13 is comprised of an outer case, which may be formed from any suitable material and which contains a plurality of batteries. A solar charger 14 is formed on the back side of the battery pack 13 and is adapted to be exposed to the sun when not under water so as to charge the batteries contained within the battery pack 13. Any suitable type of batteries and charging system can be employed, for example, the batteries themselves may be solar powered.

The battery pack 13 is adapted to be affixed to the body of the user 12 by a strap assembly which includes shoulder straps 15 that are threaded through a rigid mounting plate 16 that carries the battery pack 13 and which will engage the back of the user in a manner similar to that with conventional air tanks. In addition to the shoulder straps 15, a waist strap (not shown) may also be employed so as to permit comfortable attachment of the battery pack 13 to the body of the user 12.

The battery pack 13 is employed to power a propulsion device, indicated generally by the reference numeral 17 and which is comprised of a small electric motor 18 which drives a propeller 19 contained within a protective shroud 21. The propulsion device 17 has a pair of bar like attachments 22 that extend down its opposite sides and which are carried from the supporting plate 16 by a belt assemblies, indicated generally by the reference numeral 23 which comprises a pair of first belt sections 24 affixed to the supporting frame 16 and second belt sections 25 carried by the bars 22. A detachable buckle assembly 26 is provided at each side so as to permit the user to conveniently attach and disconnect the belt assemblies 23.

As may be seen in FIG. 1, the main purpose of the belt assemblies 23 is to provide weight distribution for the propulsion device 17 when the user is wearing the device in a body of water, as shown in this figure.

A pair of supporting tubes 27 are pivotally connected, in a manner to be described, to the battery pack 13 at one end and are rigidly connected to the propulsion device 17 at their forward ends. The pivotal connection permits the propulsion device 17 to be pivoted from its normal operative propulsion position as shown in FIG. 1 and in the solid line view of FIG. 6 to a raised out of the way position as shown in phantom lines on this figure so as to permit the convenient travel on land without interference from the propulsion device 17.

Figure 5:
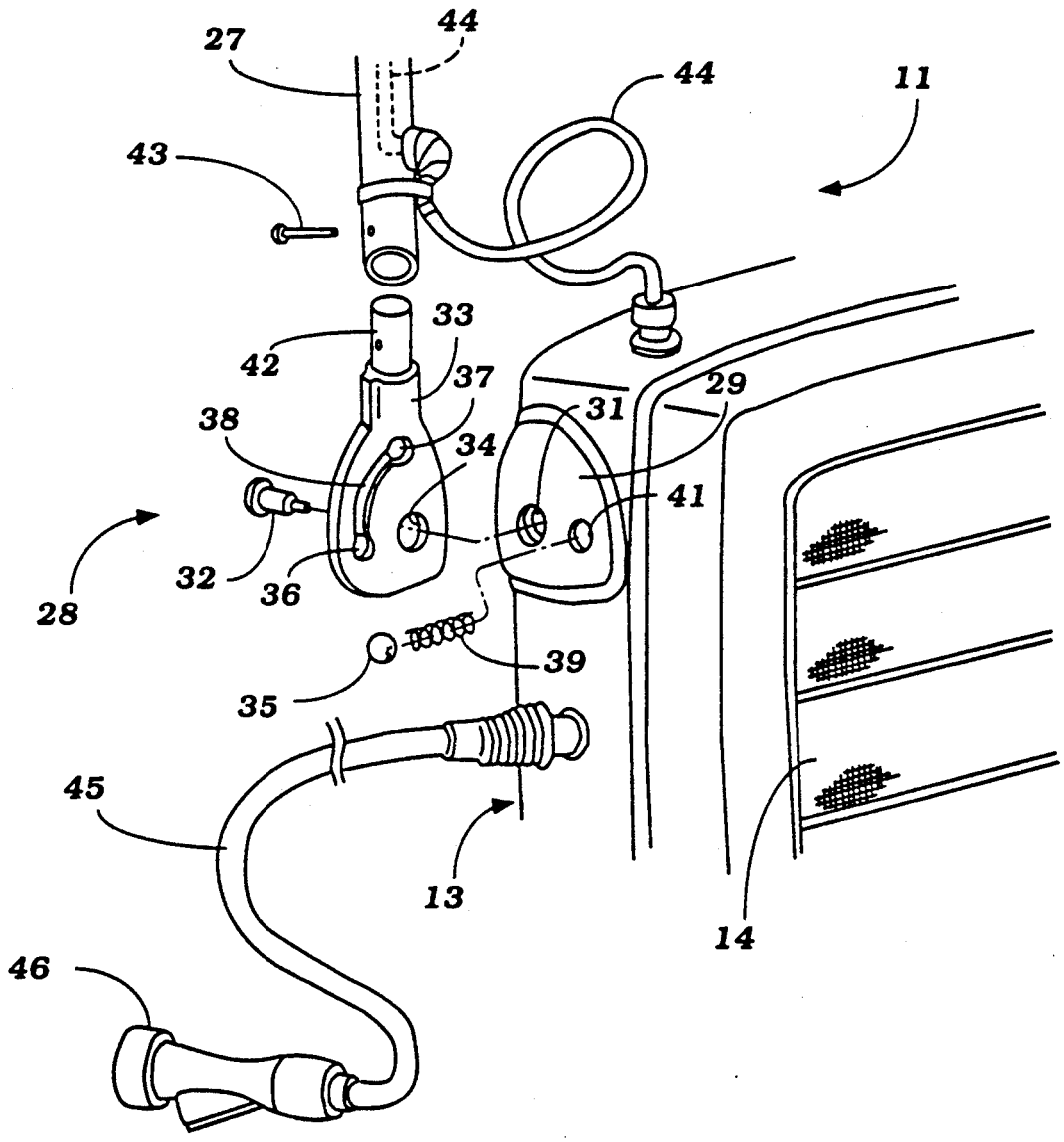
FIG. 5 is a partially exploded perspective view showing the connection between the propulsion unit and the battery pack and the control for the propulsion unit.

The connection between the tubes 27 and the battery pack 13 is indicated generally by the reference numeral 28 and has a construction as best shown in FIG. 5.

This connection includes a pair of mounting brackets 29 that are affixed at opposite sides of the battery pack 13 and each of which has a threaded opening 31 that receives a threaded end of a pivot bolt 32. The pivot bolt 32 extends through a mounting plate 33 and specifically through an aperture 34 thereof so as to provide a pivotal connection to the plate 29 of the battery pack 13. In order to releasably restrain the plate 33 in its operative and storage positions, there is provided a detent ball 35 that is adapted to be received in either of two detent recesses 36 or 37 formed at opposite ends of an arcuate slot 38 in the plate 33. The detent ball is urged by a spring 39 into engagement with the recesses 36 and 37 and the spring 39 and ball 38 are supported in a bore 41 formed in the plate 29 to one side of the threaded opening 31.

The plate 33 has a tubular extension 42 that is adapted to receive in telescoping fashion the respective frame tube 27 with a cotter pin or other type of detachable connection 43 being used to hold these elements together. Hence, for storage purposes, the frame members 27 may be conveniently detached merely by removing the pin 43.

One of the frame tubes 27 carries electrical conductors 44 which transmit power from the battery pack 13 to the electric motor 18.

A control for the electric motor 18 in the form of an on/off and rheostat control is also carried within the battery pack 13. A control cable 45 extends from one side of the battery pack 13 and terminates in a hand grip throttle mechanism 46 which the operator 12 carries in one hand and can employ to vary the speed of the motor 18 in any well known manner.

As may be seen in FIG. 1, the small size and light weight of the propulsion device 11 permits the user 12 to use this propulsion device when snorkeling and wearing a face mask 51 and employing a snorkel tube 52. Of course, any of a wide variety of recreational or other purposes can be made using the propulsion device Il. Also, it is to be understood that the foregoing description is that of a preferred embodiment of the invention. Various changes and modifications may be made without departing from the spirit and scope of the invention, as defined by the appended claims.

I claim:

1. A personal water propulsion system comprising a battery pack for containing an electrical power source, an electrically powered water propulsion device for generating a propulsion force through a body of water, pivotally supported relative to said battery pack for movement between an operative position in the front of the operator and a storage position away from the front of the operator and means for affixing said battery pack to the body of a user for propulsion through the body of water.

2. A personal water propulsion system as set forth in claim 1 wherein the means for affixing the battery pack to the body of the user comprises straps for attaching the battery pack to the back of the user.

3. A personal water propulsion system as set forth in claim 2 wherein the storage position is position over the user's head.

4. A personal water propulsion system as set forth in claim 1 wherein the battery pack further includes a solar panel for charging the batteries therein.

5. A personal water propulsion system comprising a battery pack for containing an electrical power source, said battery pack including a solar panel for charging the battery therein, an electrically powered water propulsion device for generating a propulsion force through a body of water movably carried by said battery pack, and means for affixing said battery pack to the body of the user for propulsion through the body of water.

6. A personal water propulsion system as set forth in claim 5 wherein the means for affixing the battery pack to the body of the user comprises straps for attaching the battery pack to the back of the user.

7. A personal water propulsion system as set forth in claim 6 wherein the propulsion device is pivotal between a position to the front of the body of the user and to a position over the user's head.

* * * * *